US012350562B1

(12) United States Patent
Cleeves

(10) Patent No.: US 12,350,562 B1
(45) Date of Patent: Jul. 8, 2025

(54) SHRINKABLE GRIP SLEEVE FOR SPORTS EQUIPMENT

(71) Applicant: Frederick Cleeves, Phoenix, AZ (US)

(72) Inventor: Frederick Cleeves, Phoenix, AZ (US)

( * ) Notice: Subject to any disclaimer, the term of this patent is extended or adjusted under 35 U.S.C. 154(b) by 0 days.

(21) Appl. No.: 18/899,967

(22) Filed: Sep. 27, 2024

Related U.S. Application Data

(60) Provisional application No. 63/572,640, filed on Apr. 1, 2024.

(51) Int. Cl.

| | |
|---|---|
| ***A63B 60/14*** | (2015.01) |
| ***A63B 60/12*** | (2015.01) |
| ***A63B 60/18*** | (2015.01) |
| ***A63B 60/54*** | (2015.01) |

(52) U.S. Cl.
CPC ..... *A63B 60/14* (2015.10); *A63B 60/12* (2015.10); *A63B 60/18* (2015.10); *A63B 60/54* (2015.10)

(58) Field of Classification Search
CPC ..... A63B 60/12; A63B 60/14; A63B 60/18; A63B 60/54
USPC ..... 473/300, 303, 549, 568
See application file for complete search history.

(56) References Cited

U.S. PATENT DOCUMENTS 3,716,433 A * 2/1973 Plummer ..... B29C 66/242 473/568
5,482,270 A * 1/1996 Smith ..... A63B 60/12 473/568
5,730,662 A * 3/1998 Rens ..... A63B 60/10 473/549
5,944,617 A * 8/1999 Falone ..... A63B 60/06 473/549
6,148,483 A * 11/2000 DeGraff ..... A63B 59/50 16/431
6,235,134 B1 * 5/2001 Mueller ..... B25G 1/10 156/84
7,833,117 B2 * 11/2010 Tiura ..... B25G 1/01 473/549
8,016,692 B2 * 9/2011 Kumamoto ..... A63B 60/52 473/303
8,801,530 B2 * 8/2014 Beck ..... A63B 71/0622 473/201
10,371,481 B2 * 8/2019 Johnson ..... F42B 6/003
2006/0168710 A1 * 8/2006 Vito ..... B32B 7/022 2/267
2008/0263829 A1 * 10/2008 Diasio ..... A63B 60/06 264/293

(Continued)

*Primary Examiner* — Joseph B Baldori
(74) *Attorney, Agent, or Firm* — Bruce A. Lev

(57) ABSTRACT

A shrinkable grip sleeve for sports equipment formed from a flexible and heat-shrinkable material having a tubular shape that is adapted to be placed over an existing grip. In use, the grip sleeve is placed over the existing grip, and then a heat source is used to shrink the grip sleeve around and tightly upon the existing grip forming a new and improved grip. A series of raised bump members can be included and attached to the existing grip before placing the grip sleeve over the existing grip. The position of the series of raised bump members are determined by the proper placement of a person's hands upon the existing grip and used to aid in the position and alignment of the person's hands after the grip sleeve is installed upon the existing grip. A series of ridges and grooves can also be incorporated for improved performance and durability.

10 Claims, 5 Drawing Sheets

(56) References Cited

U.S. PATENT DOCUMENTS

| | | | | |
|---|---|---|---|---|
| 2009/0162651 | A1* | 6/2009 | Rios | A63B 60/08<br>428/419 |
| 2018/0304131 | A1* | 10/2018 | Sorenson | A63B 60/14 |
| 2019/0178607 | A1* | 6/2019 | Johnson | A63B 60/08 |

* cited by examiner

SHRINKABLE GRIP SLEEVE FOR SPORTS EQUIPMENT

CROSS-REFERENCE TO RELATED APPLICATION

The present application is related to and claims priority from prior provisional application Ser. No. 63/572,640, filed Apr. 1, 2024 which is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71 (d).

BACKGROUND OF THE INVENTION

1. Field of the Invention

This invention relates generally to grips for sports equipment, and more specifically to replacement grips for sports equipment.

2. Description of the Related Art

Prior art grips for sports equipment wear and tear over time and also accumulate oils and dirt upon their surfaces thereby reducing the friction between a user's hands and the grip resulting in a reduction of performance. Most are formed as hard rubber or glued leather or the like that are difficult to clean and remove. Replacing unwanted grips can be very laborious and expensive. Most replacement sports equipment grips are expensive, have a short useful life and need to be installed and/or removed by a professional which can take several days. Grip wrap tape can be used and is inexpensive but difficult to install and results in an uncomfortable, uneven surface that decays quickly. Thus, a need exists for an improved grip replacement or repairing system to avoid the above-mentioned problems.

BRIEF SUMMARY OF THE INVENTION

In view of the foregoing disadvantages inherent in the known types of grips for sports equipment or the like in the prior art, the present invention provides a novel shrinkable grip sleeve. As such, the general purpose of the present invention, which will be described subsequently in greater detail, is to provide a shrinkable grip sleeve for sports equipment formed from a flexible and heat-shrinkable material having a tubular shape that is adapted to be placed over an existing grip, and then using a heat source to shrink the grip sleeve around and tightly upon the existing grip forming a new and improved grip. Further, a series of raised bump members can be included and attached to the existing grip before placing the grip sleeve over the existing grip. The position of the series of raised bump members are determined by the proper placement of a person's hands upon the existing grip and used to aid in the position and alignment of the person's hand after the grip sleeve is installed upon the existing grip. Furthermore, the series of raised bump members can be used to determine where a user should place their hands on the grip and how much pressure to apply in those locations. Furthermore, a series of ridges and grooves can also be incorporated for improved performance and durability.

There has thus been outlined, rather broadly, the more important features of the invention in order that the detailed description thereof that follows may be better understood and in order that the present contribution to the art may be better appreciated. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, a shrinkable grip sleeve for sports equipment, constructed and operative according to the teachings of the present invention.

The various embodiments of the present invention will hereinafter be described in conjunction with the appended drawings.

DETAILED DESCRIPTION

Figure 1:
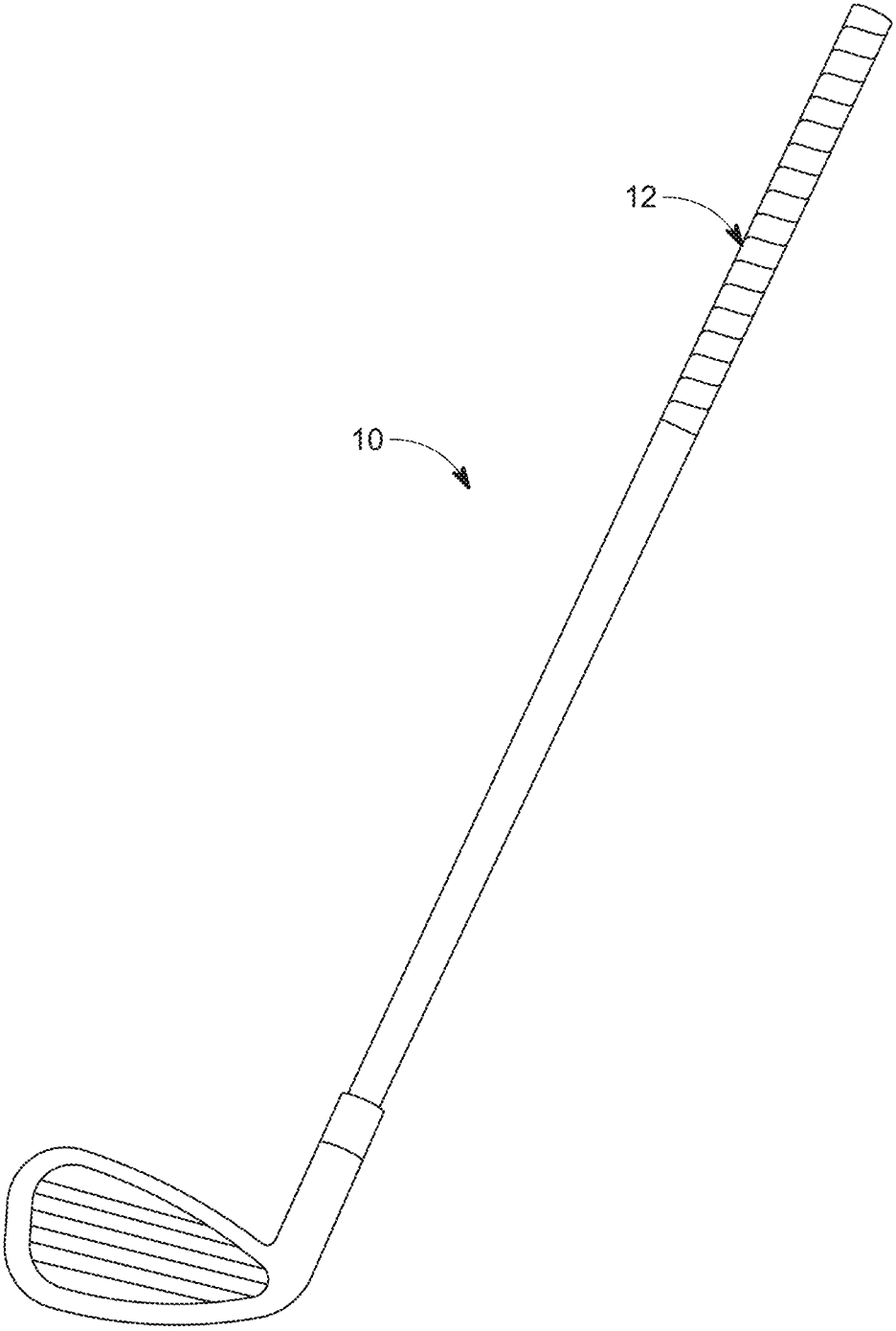
FIG. 1 (Prior Art)
FIG. 1 shows a prior art golf club with a grip.
Figure 2:
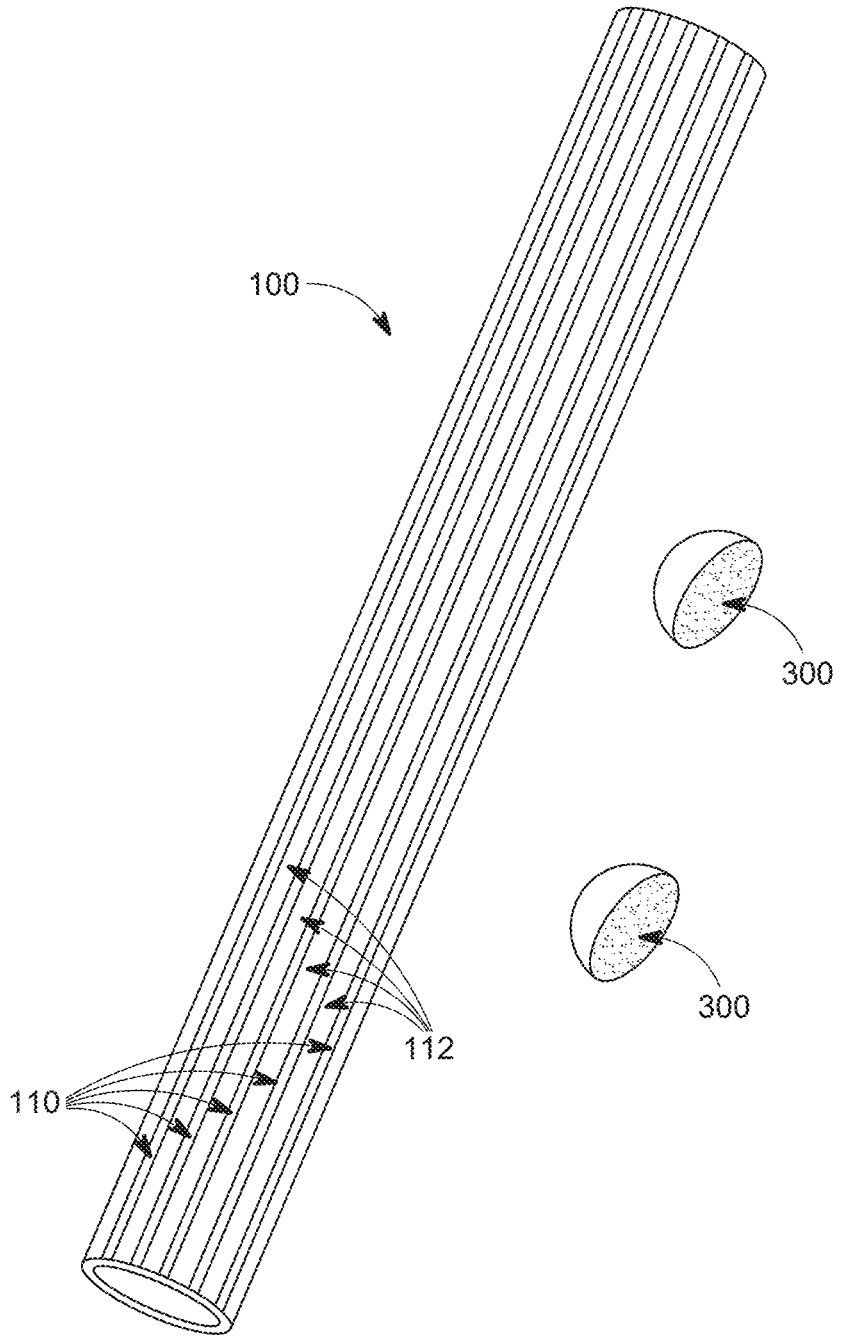
FIG. 2 shows a perspective view illustrating the shrinkable grip sleeve including a series of ridges and grooves and optional raised bump members for sports equipment according to the preferred embodiment of the present invention.
Figure 3:
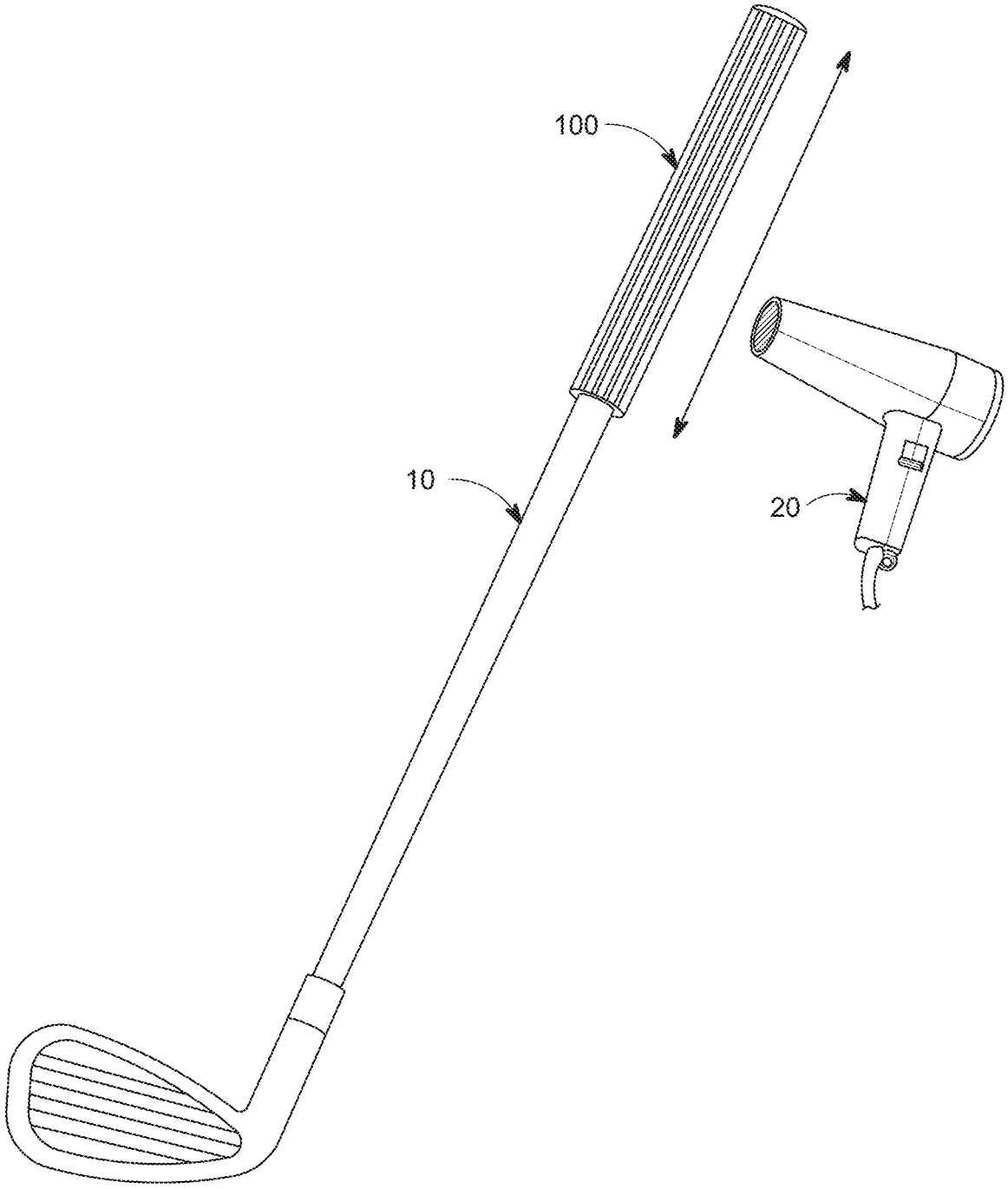
FIG. 3 shows the shrinkable grip sleeve for sports equipment according to the preferred embodiment of the present invention of FIG. 2 installed upon the grip of the golf club of FIG. 1 and being shrunk fit thereon using a heat source.
Figure 4:
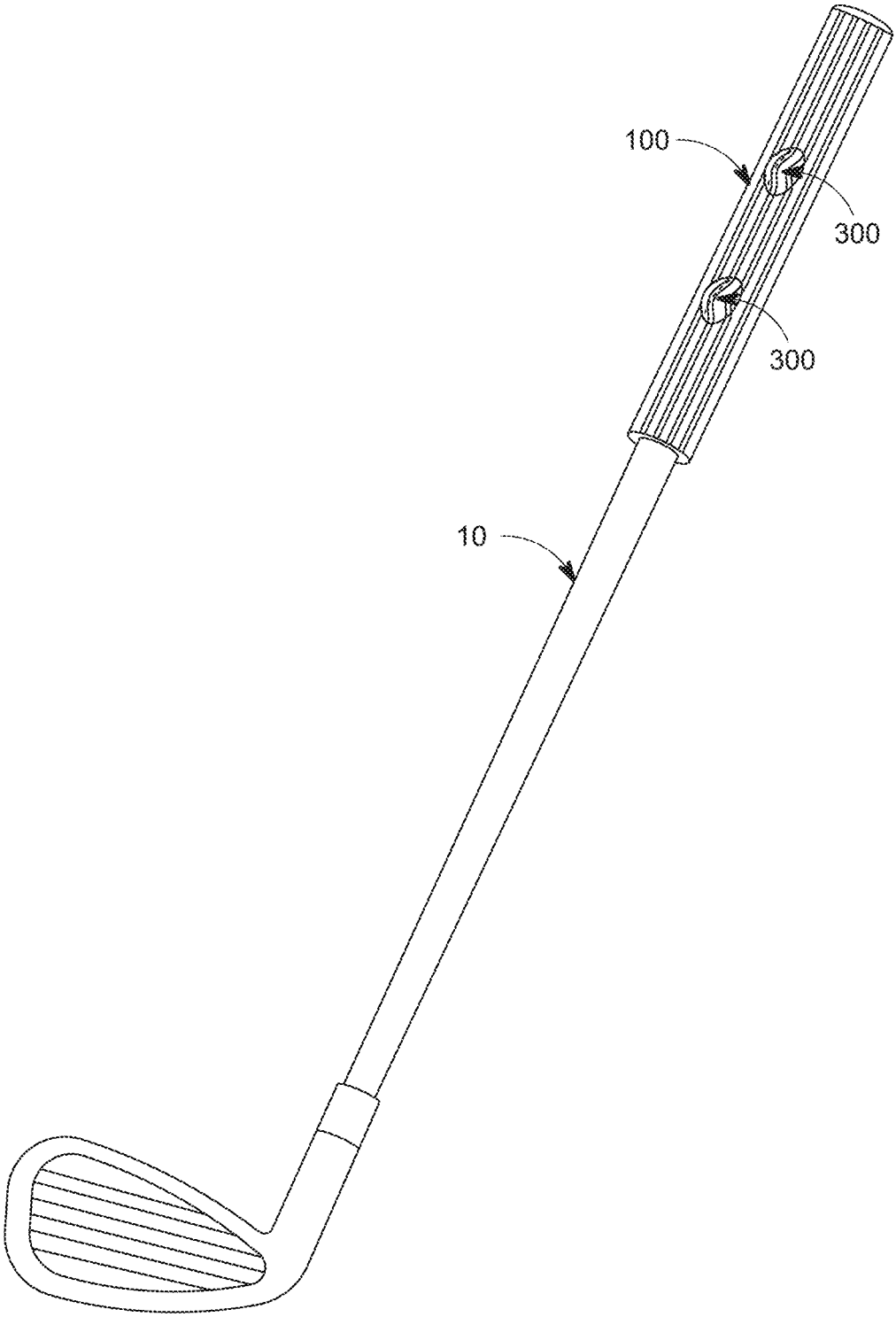
FIG. 4 shows the series of raised bump members installed on the shaft of the golf club under the grip sleeve.
Figure 5:
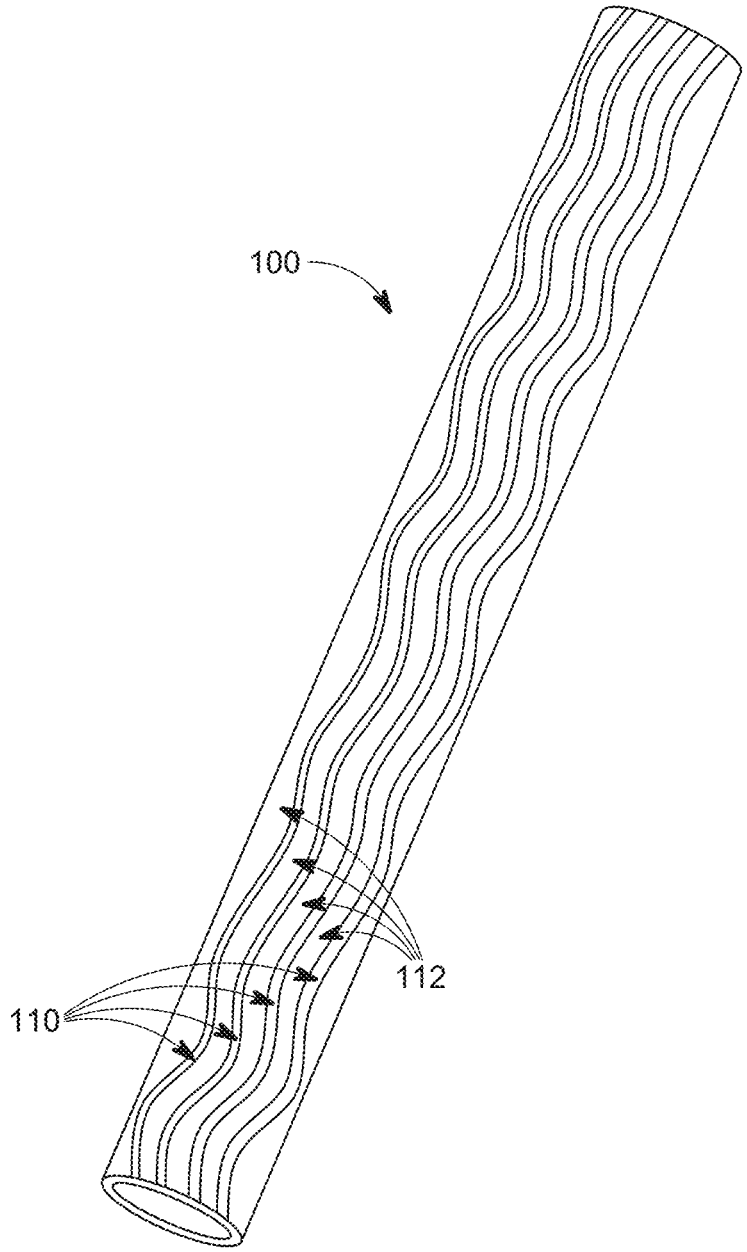
FIG. 5 shows the shrinkable grip sleeve for sports equipment including a series of ridges and grooves in a wavy pattern.

As discussed above, embodiments of the present invention relate to a shrinkable grip sleeve for sports equipment. The shrinkable grip sleeve is designed and manufactured to protect, renew, personalize and improve on a traditional or existing sports equipment grip (such as on baseball bats, tennis rackets, golf clubs, hockey sticks, fishing rods, etc., with a shock absorbing, heat-shrinkable, rubber-like sleeve/tubing that can be shrunk-fit over the original grip easily by the consumer. The shrinkable grip sleeve will make protecting, renewing, personalizing and improving a sports equipment grip less expensive and less time consuming. The consumer can easily adhere a shrinkable grip sleeve around an existing sports equipment grip in minutes using a common heat gun, hair drier or other safe heat producing source, Referring now to the drawings, FIGS. 1-5, the shrinkable grip sleeve 100 for sports equipment is formed from a flexible and heat-shrinkable material having a tubular shape that is adapted to be placed over an existing grip 12 on a golf club 10, or the like. In use, the grip sleeve 100 is placed over the existing grip 12, and then a heat source, for example a hair dryer 20, is used to shrink the grip sleeve 100 around and tightly upon the existing grip 12 forming a new and improved and/or enhanced grip.

The grip sleeve 100 can be formed from a polyolefin compound that is extruded to be used specifically as a shock absorbing and rubber-like shrinkable grip sleeve. The grip sleeve 100 can be produced in different colors, and with ridges 110 and grooves 112 set in repeating designs to be more consumer safe, more efficiently gripped, and uniquely attractive and personalized. Other chemical compounds and variations thereof can be mixed together to achieve different desired characteristics.

The ridges 110 and grooves 112 will not only increase the grip ability of the grip sleeve but also allow dirt and oils in a user's hand to migrate into the grooves keeping the ridges on the grip sleeve more grippable at all times while also making the grip sleeve easier to clean. The ridges 110 and grooves 112 can be formed in straight lines, or wavy lines, or curved lines, or any variation that can increase the friction between a user's hands and the grip. The rigidity and density of the ridges 110 can also be varied in order to make them soft enough to bend or flex in order to dampen shock and vibrations through the handle of a club when striking a ball or when/if the club impacts a ground surface, thereby helping to reduce injuries to the user.

The grip sleeve 100 can also be turned inside-out (reversed) and shrunk onto an old grip for a smoother feel. Including a UV resistant additive can increase the useful life span of the grip sleeve over traditional grips. The grip sleeve 100 can also be printed upon for advertising or specialty applications. When reversed, inside-out (reversed), the ridges create air pockets, which can reduced or deaden vibrations therethrough when in use.

In use, the grip sleeve 100 only needs a safe heat source, such as a heat gun, a hair dryer 20, a toaster, a toaster oven, etc., to shrink the grip sleeve around the existing grip. Furthermore, a loose grip sleeve can easily be re-tightened at any time by applying additional heat to the sleeve. To cut the grip sleeve100 to the length necessary or remove a grip sleeve the consumer needs only scissors. To make the grip sleeve adhere better, a spray adhesive can be applied to the existing grip before the new grip sleeve is shrunk into place.

In an alternate embodiment, the grip sleeve 100 can be formed of multiple layers of material having different properties, such that when heated the shrinking effect on each varies causing different effects upon the grip sleeve and the grip being covered. Further embodiments may include strands of differing material, such that when heated the shrinking effect between the strands and the main substrate varies causing different effects and enhancements upon the grip being covered while offering an external surface having ridges caused by the strands for increased friction between the user's hands and the grip sleeve outer surface.

Specialized tools have also been created to aid in reversing the improved grip sleeve 100 between a smooth surface on one side and a ridged surface on the opposite side. As such, a golfer can use the same improved grip sleeve 100 for two different choices and reasons.

Another aspect of the instant invention is the inclusion of a series of raised bump members 300 that may include an adhesive backing for releasable attachment to an existing grip or shaft of a handle of any of a variety of sports equipment. The position of the series of raised bump members are determined by the proper placement of a person's hands upon the existing grip and used to aid in the position and alignment of the person's hands after the grip sleeve 100 is installed upon the existing grip. The series of raised bump members 300 are attached to the handle of the existing golf club 10 and then the grip sleeve 100 is placed over the series of raised bump members 300 and handle thereby forming the new handle of the golf club.

Advantages of the improved grip sleeve 100 include:

a. lasts longer than most grips;
b. costs less than most grips;
c. costs less to ship than most grips;
d. golfers can self-install the improved grip sleeve in just minutes;
e. the improved grip sleeve is reversible between grooved or smooth surfaces;
f. linear grooves and ridges improve gripping and reduces grip twisting of golfer's hands during swings, and allow air flow below the golfer's hands keeping them cooler and less likely to sweat;
g. Polyolefin material makes the grip resistant to oils, chemicals, dirt, and moisture, and is easy to clean;
h. Oils, chemicals, dirt, and moisture migrate away from the ridges and into the grooves keeping hands adhering to the grip;
i. fits over both standard and mid-size grips;
j. shrinks tightly and securely around existing grips and adds only approximately 1/16" in diameter to the existing grips;
k. reduces material waste by using, fitting around, and over existing grips;
l. improves grip control, increases club head speed, improves a golfer's proficiency, and improves a golfer's overall game.

Other uses are also possible for the improved grip sleeve, including for installment upon medical mobility aids, crutches and canes, home and garden tools, power tools, bicycle and scooter handles, and exercise equipment.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention.

What is claimed is:

1. A grip sleeve kit for sports equipment, said kit comprising:

a plurality of raised bump members;

wherein said plurality of raised bump members are disconnected from one another;

wherein said plurality of raised bump members are adapted to be releasably attached to existing grips of sports equipment in a configuration spaced from one another; and wherein the positioning of each of said plurality of raised bump members is adjustable with respect to one another, such that said space between each of said plurality of raised bump members is adapted to accommodate differently sized hands and fingers of users; and a grip sleeve comprising:

a main body;

wherein said main body is formed having an elongated tubular shape defining a length thereof, and is shaped and adapted to fit over and be placed upon said existing grips of said sports equipment;

wherein said main body is formed having an inner surface and an outer surface; and wherein said main body is formed from a heat-shrinkable material, and is adapted such that after being installed upon an existing grip it can be shrunk using a heat source to snugly fit upon said existing grip;

wherein said plurality of raised bump members are adapted to be releasably attached to existing grips of sports equipment in a predetermined spaced configuration before said grip sleeve is fit over and be placed upon said existing grips of said sports equipment, such that said grip sleeve is adapted to cover and fit snugly upon said plurality of raised bump members and said existing grip of said sports equipment; and wherein said plurality of raised bump members are adapted to form bumps upon said grip sleeve and adapted to aid in the positioning and alignment of a said user's hands during the use of said sports equipment.

2. The grip sleeve kit of claim 1, wherein said main body further includes:

a series of ridges and grooves;

wherein said series of ridges and grooves extend over a substantial portion of said length of said outer surface of said main body, are adapted to increase friction between said grip sleeve and a user's hands, are adapted to allow air to flow between said grip sleeve and a user's hands when in use; and adapted to reduce shock and vibrations therethrough.

3. The grip sleeve kit of claim 2, wherein said series of ridges and grooves are parallel to one another and form a wavy pattern.

4. The grip sleeve kit of claim 3, wherein said inner surface of said main body is formed having a smooth texture.

5. The grip sleeve kit of claim 4, wherein said main body is adapted to be reversible, such that said outer surface can become the inner surface and contact said existing grip, and said inner surface can become the outer surface, such that said user can choose which surface to contact when said grip sleeve is in use.

6. The grip sleeve kit of claim 1, wherein said heat-shrinkable material is formed from polyolefin.

7. The grip sleeve kit of claim 1, further comprising:

a heat source;

wherein said heat source is adapted to shrink said grip sleeve around said existing grip.

8. The grip sleeve kit of claim 7, wherein said heat source is chosen from a list of heat sources consisting of a heat gun, a hair dryer, a toaster, and a toaster oven.

9. The grip sleeve kit of claim 1, wherein said plurality of raised bump members are formed having a semi-circular cross section.

10. The grip sleeve kit of claim 9, wherein said plurality of raised bump members are formed having a circular cross section perpendicular to said semi-circular cross section.

* * * * *